US005316316A

United States Patent [19]

Lai

[11] Patent Number: 5,316,316

[45] Date of Patent: May 31, 1994

[54] TENNIS RACKET HANDLE

[76] Inventor: Genhone Lai, 6F, No. 20, Alley 50, Lane 119, Tung Hu Road, Neihu District, Taipei, Taiwan

[21] Appl. No.: 19,845

[22] Filed: Feb. 19, 1993

[51] Int. Cl.[5] ..... A63B 49/08

[52] U.S. Cl. ..... 273/73 J; 273/75

[58] Field of Search ..... 273/73 R, 73 J, 75, 273/67 R, 67 A, 67 DA, 72, 80 R, 80 B

[56] References Cited

U.S. PATENT DOCUMENTS

| | | |
|---|---|---|
| 2,083,872 | 6/1937 | Siegel . |
| 2,775,455 | 12/1956 | Liberti . |
| 3,295,850 | 1/1967 | Garrity . |
| 3,782,725 | 1/1974 | Giambazi . |
| 3,995,856 | 12/1976 | Hollendorfer, Jr. . |
| 4,717,152 | 1/1988 | Kessler . |
| 4,736,950 | 4/1988 | Doyle . |
| 4,836,544 | 6/1989 | Lai . |
| 4,964,645 | 10/1990 | Lai . |

FOREIGN PATENT DOCUMENTS

| | | | |
|---|---|---|---|
| 3628618 | 11/1987 | Fed. Rep. of Germany | 273/73 J |
| 3726753 | 2/1989 | Fed. Rep. of Germany . | |
| 2232337 | 1/1975 | France . | |
| 8504814 | 11/1985 | World Int. Prop. O. | 273/75 |
| WO89/02297 | 3/1989 | World Int. Prop. O. . | |
| 8902297 | 3/1989 | World Int. Prop. O. | 273/73 J |

*Primary Examiner*—Vincent Millin
*Assistant Examiner*—Raleigh W. Chiu
*Attorney, Agent, or Firm*—Bacon & Thomas

[57] ABSTRACT

A tennis racket handle is disclosed having an improved handle configuration which eliminates protruding points which may impact the hypothenar eminence of the palm. The butt end of the handle has a cross-sectional shape that is dis-similar to the cross-sectional shape of a middle portion of the handle, approximately 12 cm from the butt end. The butt end and middle portion are connected by a transition zone polyhedron has a number of planar sides against which the hypothenar eminence may bear to eliminate the discomfort of the protruding points of the known handles.

27 Claims, 12 Drawing Sheets

FIG.1-A (PRIOR ART)
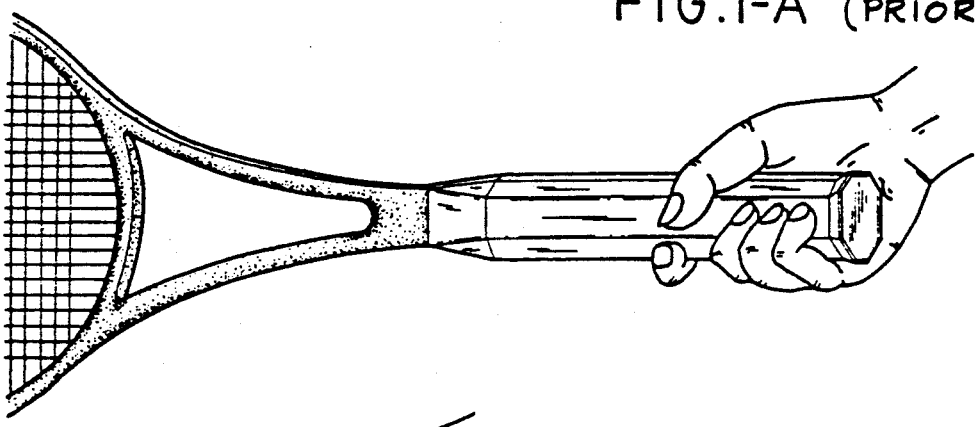
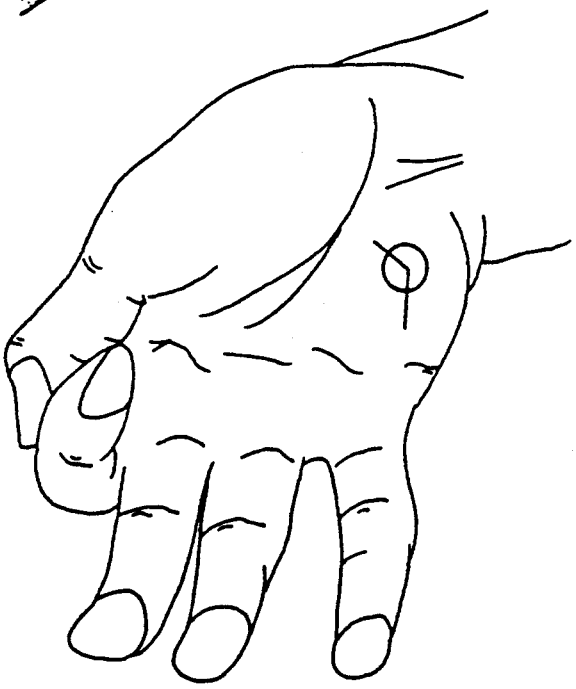
FIG. 1-B
(PRIOR ART)
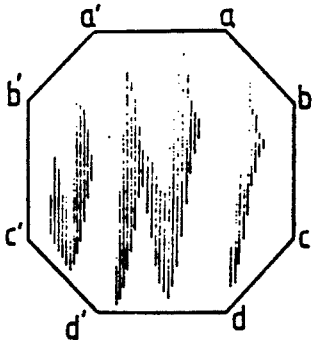
FIG. 1-C
(PRIOR ART)

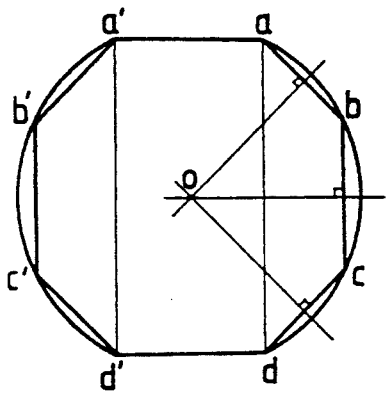
FIG. 10
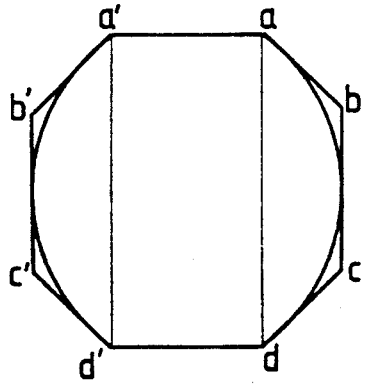
FIG. 10-A

TENNIS RACKET HANDLE

BACKGROUND OF THE INVENTION

The invention herein consists of an improved tennis racket handle and is an improvement of the laterally protruding points at the butt-end plane on the polyhedral handles of conventional tennis rackets. The protruding points on the known handle will impact the hypothenar eminence of the palm when the handle is grasped and may cause calluses (hardening and thickening of the skin). With respect to the cross-sectional protruding points on the butt end of a conventional tennis racket handle, the present invention innovatively improves the shape of the butt-end of the tennis racket handle by converting the laterally protruding points into oblique planar surfaces that eliminate the formation of calluses and also offer the active palmar muscles more grip, comfort and improved spatial positioning.

Most conventional tennis racket handles are polyhedrons that have a symmetrical polygon cross-section at a middle portion of the tennis racket handle. The butt-end section of the tennis racket handle extends outwardly and its cross-sectional area is larger than the cross-sectional area of the middle portion, although the two may be similar octagons. As indicated FIGS. 1A, 1B and 1C, the inventor is knowledgeable that when conventional tennis racket handles are being used, the laterally protruding points on the butt-end of the tennis racket handle act as points protruding into the hypothenar eminence of the palm and cause the inefficient exertion of strength. Furthermore, they produce calluses (thickening and hardening of the skin) as well as other shortcomings.

SUMMARY OF THE INVENTION

The main objective of the invention herein is to offer an improved tennis racket handle, similar to the cross-section of a diamond, in which the cross-sectional lateral protruding points on the butt-end of a tennis racket handle are changed into an oblique side that avoids intrusions into the hypothenar eminence of the palm, and also provides the sports grasping muscles with more grip, comfort and spatial position than the known tennis racket handle.

The invention herein effectively overcomes a major shortcomings of conventional tennis racket handles, specifically the lack of a positive gripping surface, by introducing a new shape for a tennis racket handle that effectively minimizes epidermal and muscular stress during routine usage. While the manufacturing process and technological method required to produce a tennis racket with the new handle having a shape according to the invention herein is generally similar to the manufacturing processes and technology utilized in the production of conventional tennis rackets, there are certain production changes that must be incorporated with regard to the shaping of the handle in order to adapt the aforementioned advantages and improvements of the invention herein.

BRIEF DESCRIPTION OF THE DRAWINGS

FIG. 1-A is an illustration of a hand grasping a conventional tennis racket handle.

FIG. 1-B shows the point of contact with the hypothenar eminence from the lateral protruding corner on the butt-end of the conventional tennis racket handle.

FIG. 1-C is an end view showing the cross-section of the butt-end of a conventional tennis racket handle.

FIG. 10 is an end view of the butt end of a tennis racket handle according to the present invention herein showing the lateral trapezoids, exterior arcs, conversion and forming of a new polygon at the butt end.

FIG. 10-A is an end view of the butt end of the tennis racket handle according to the present invention showing the lateral trapezoids interior arcs, conversion and forming of a new polygon at the butt end.

DETAILED DESCRIPTION OF THE PREFERRED EMBODIMENTS

Before introducing the invention herein, it will first be necessary to briefly explain the areas in the structure of conventional tennis racket handles which require improvement by comparing a conventional tennis racket handle structure and the improved structure of the tennis racket handle.

Figure 2:
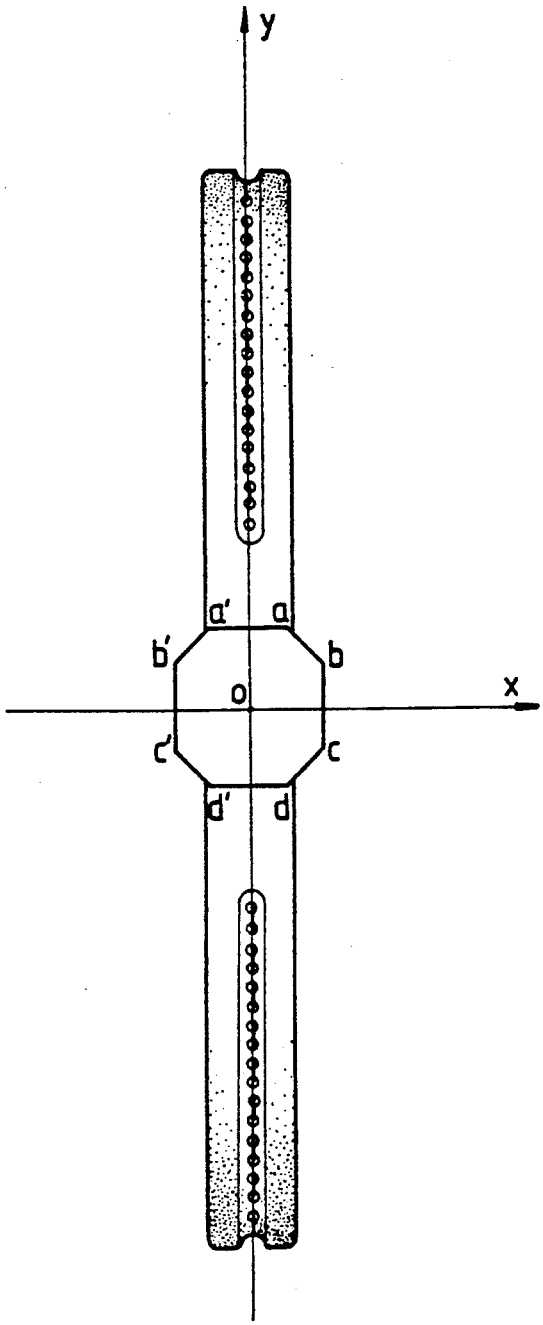
FIG. 2 (PRIOR ART)
FIG. 2 is an end view of the butt-end of a conventional tennis racket handle, with plane surface coordinate positions.
Figure 3:
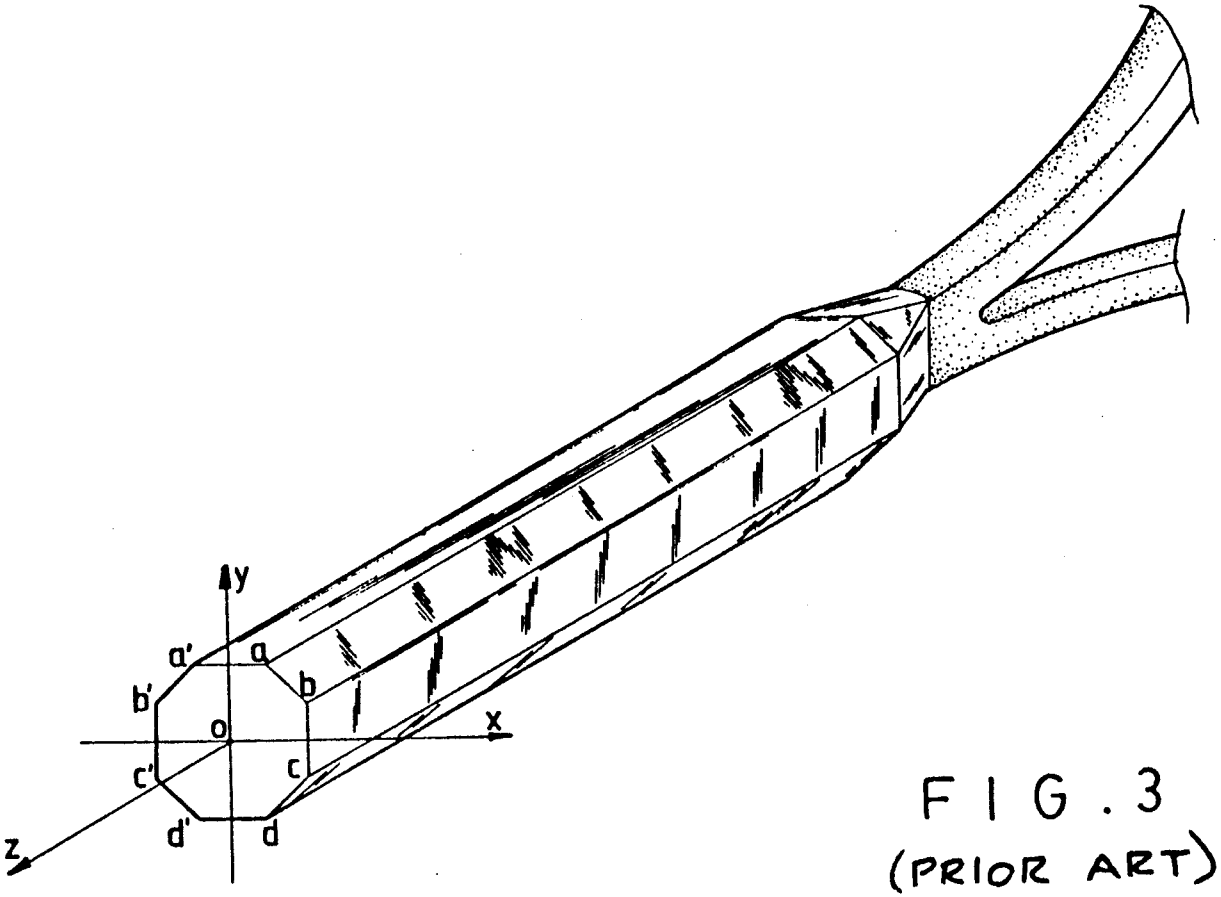
FIG. 3 (PRIOR ART)
FIG. 3 is a partial perspective view of a conventional tennis racket handle, with spatial coordinate positions.

Referring to FIG. 2 and FIG. 3 illustrating the aforementioned conventional tennis racket handle, the cross-sectional plane surface coordinates relating to positions on the tennis racket face and tennis racket handle are indicated in FIG. 2; furthermore, the center axis of the tennis racket is the traversal axis on the spatial coordinate z-axis. The axis passes through the butt end of the tennis racket handle at the point 0 and also passes through the face of the tennis racket handle to become an axis perpendicular to the horizontal axis (x) and the vertical axis (y). As aforementioned and indicated in FIG. 2, sides $\overline{bc}$ and $\overline{b'c'}$ are parallel to the vertical axis; sides $\overline{a\,a'}$ and $\overline{d\,d}$ are parallel to the horizontal axis; and $\overline{ab}$, $\overline{cd}$, $\overline{a'b'}$, and $\overline{c'd'}$ are oblique sides.

Figure 4A:
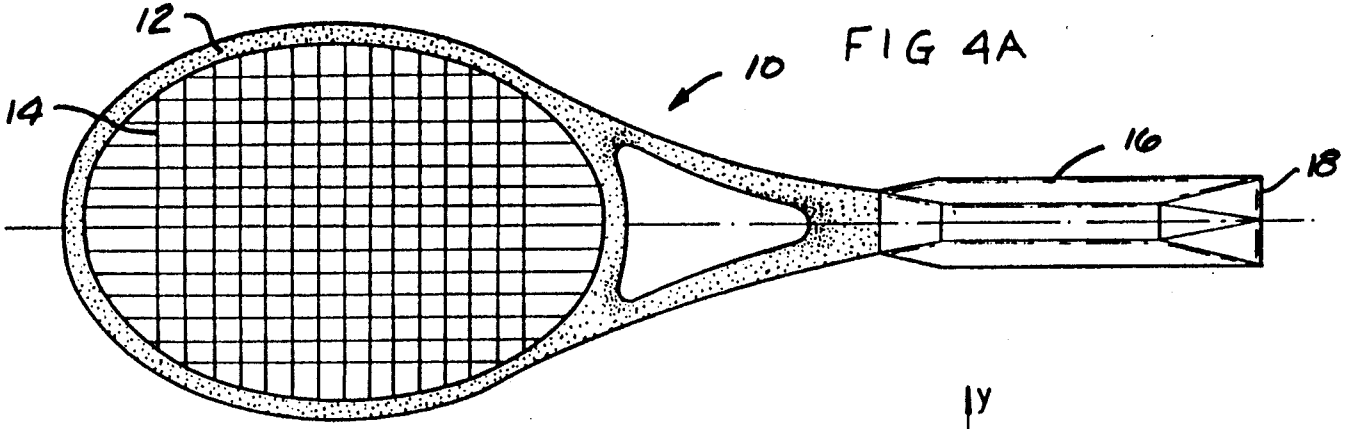
FIG. 4A is a front view of a tennis racket having a handle according to a first embodiment of the present invention with an octagonal cross-section at the middle portion and a hexagonal cross-section at the butt-end plane.
Figure 4B:
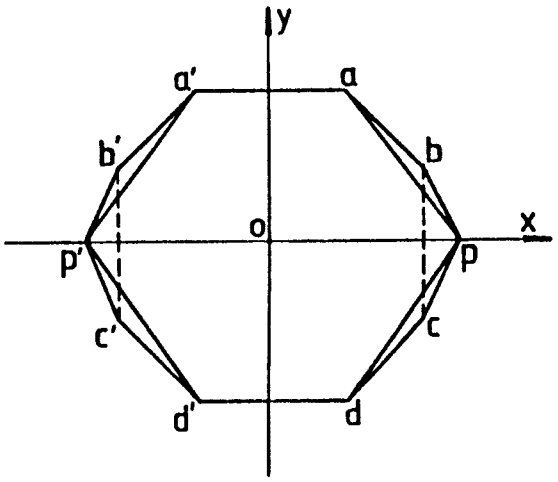
FIG. 4B is an end view of the butt-end of the handle shown in FIG. 4A.

The conventional octagonal cross-section tennis racket handle with the butt end has the shortcoming of having lateral corners which protrude into the hypothenar eminence of the grasping palm and which produce calluses (hardened and thickened skin). The present invention integrates two symmetrical polygons at the middle and butt end to enable the elimination of the protruding corners by changing the corners into oblique planar surfaces to provide the active palmar muscles with more grip and a comfortable spatial position. As illustrated in FIGS. 4A and 4B the tennis racket 10 has a head portion 12 which, in known fashion, has strings 14 defining a planar hitting surface extending parallel to the Y axis, and a handle 16 which integrates an octagonal cross-section at the middle portion with the hexagon apdd'p'a' at the butt-end plane 18. The result will be the octagon abcdd'c'b'a' at the middle portion as in a conventional tennis racket handle and, with regard to the aforementioned laterally protruding point b, since the side $\overline{bc}$ is reduced close to a value of zero, point p is formed, thus eliminating point b, to form the oblique side $\overline{ap}$ and thereby attaining the objective of the invention. By the same principle laterally protruding points b', c' and c can also be converted into the oblique sides $\overline{a'p'}$, $\overline{p'd'}$ and $\overline{pd}$ and become the new shape of the invention herein.

Figure 5A:
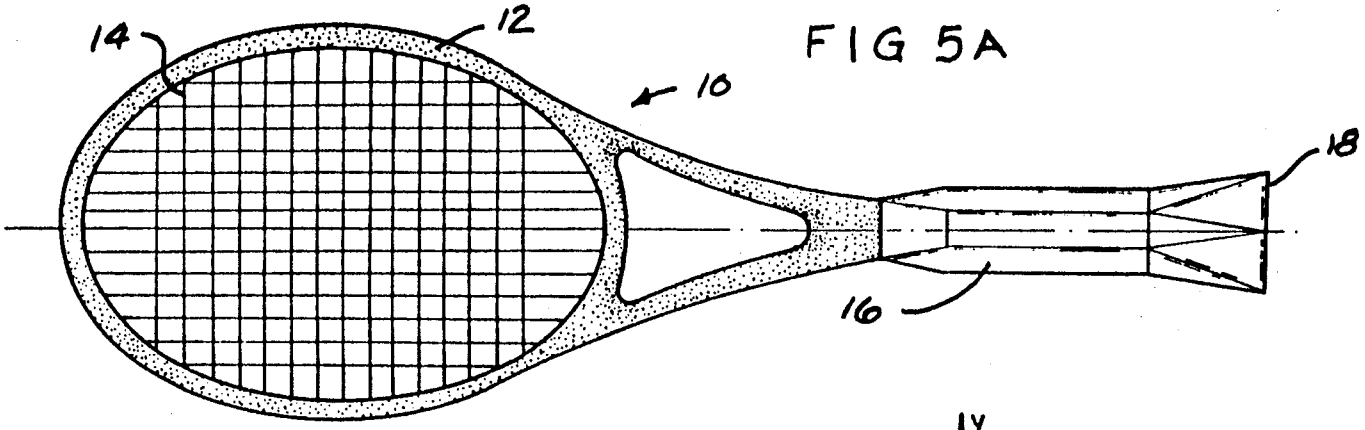
FIG. 5A is a front view of a tennis racket having a handle according to a second embodiment of the present invention with an octagonal cross-section at the middle portion and an enlarged hexagonal cross-section at the butt-end plane.
Figure 5B:
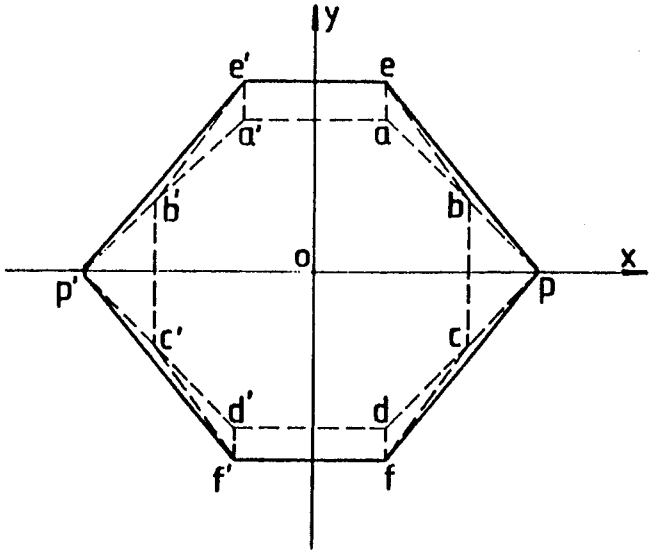
FIG. 5B is an end view of the butt-end of the handle shown in FIG. 5A.

In the embodiment illustrated in FIGS. 5A and 5B, the handle consists of the octagonal cross-section at the middle portion and the hexagon epff'p'e' at the butt end 18. Also, sides $\overline{a\,a'}$ and $\overline{d\,d'}$ are both extended outwardly from axis (z) passing through point 0 to become $\overline{e\,e'}$ and $\overline{f\,f'}$, respectively. Furthermore, side $\overline{bc}$ is reduced to a value close to zero, to form point p eliminating the laterally protruding point b to form oblique side $\overline{ep}$, thereby also attaining the aforementioned objective indicated in FIG. 4. By the same principle oblique sides e'p', p'f' and $\overline{pf}$ form another new shape of the tennis racket handle of the present invention.

Figure 6A:
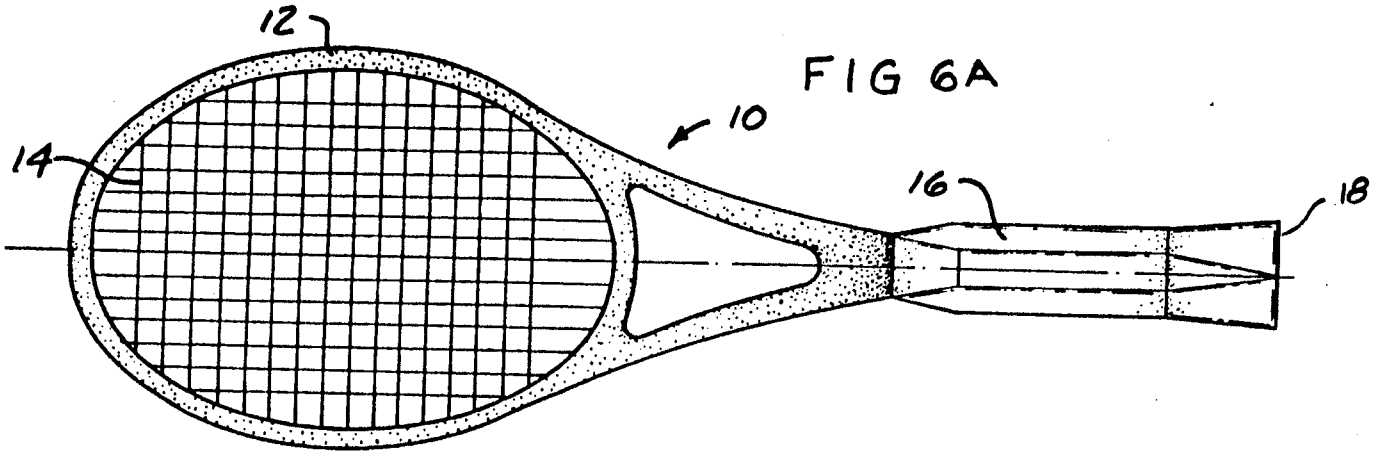
FIG. 6A is a front view of a tennis racket having a handle according to a third embodiment of the present invention with an octagonal cross-section at the middle portion and a tetragonal cross-section at the butt-end plane.
Figure 6B:
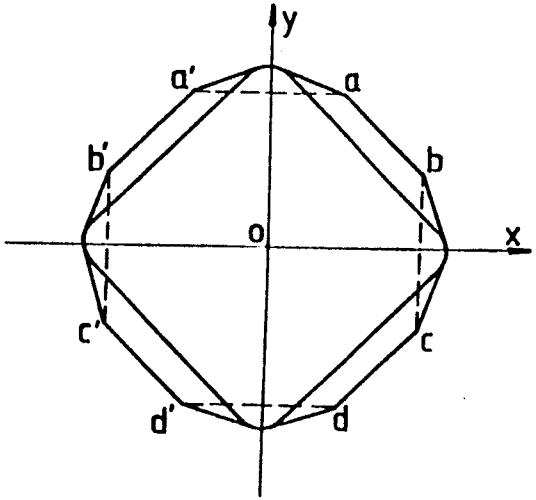
FIG. 6B is an end view of the butt-end of the handle shown in FIG. 6A.

As illustrated in FIGS. 6A and 6B, the invention may also consist of the integration of the middle portion having an the octagonal cross-section abcdd'c'b'a' with the butt-end cross-section which is changed such that the sides $\overline{a\,a'}$ and $\overline{d\,d'}$ which are parallel to the horizontal axis, as well as the sides $\overline{bc}$ and $\overline{b'c'}$ which are parallel to the vertical axis are reduced in length or even reduced to small arcs to thereby enable the original end points a, b, c, d, d', c', b' and a' to be eliminated in the conversion process and formed into four oblique sides.

Based on the aforementioned applications of the invention herein the cross-section of the middle portion (a distance approximately 12 cm from the butt end of the tennis racket handle) and the cross-section of the butt end of the tennis racket handle consist of two dissimilar polygons that are mutually integrated by a transition zone to change the shape to produce an improved innovative shape which eliminates the laterally protruding points on the butt end of a conventional tennis racket handle and which also provides more comfortable flat angular sides. Moreover, the basic conditions of the aforementioned are (1) the facing angles should be equal; (2) the size of each of the facing sides should be equal. Thus, in the present invention, the two polygons (at the middle portion and at the butt end) may have different numbers of sides and are therefore of different (or non-similar) shapes, or are polygons in which the oblique sides are larger than the sides which are parallel to the vertical axis. Even if the two polygons are both octagons, the octagons of the present invention would not be similar to the octagons of the cross-section of a conventional tennis racket handle in which the oblique sides are smaller than the sides which are parallel to the vertical axis.

The aforementioned oblique sides of the invention herein refer to the skewed line segments which are subject to the same limits in that the aforesaid line segments are not parallel to the vertical axis nor parallel to the horizontal axis which serve as the cross-sectional plane surface coordinates of the tennis racket handle, as illustrated in FIG. 2.

Figure 7:
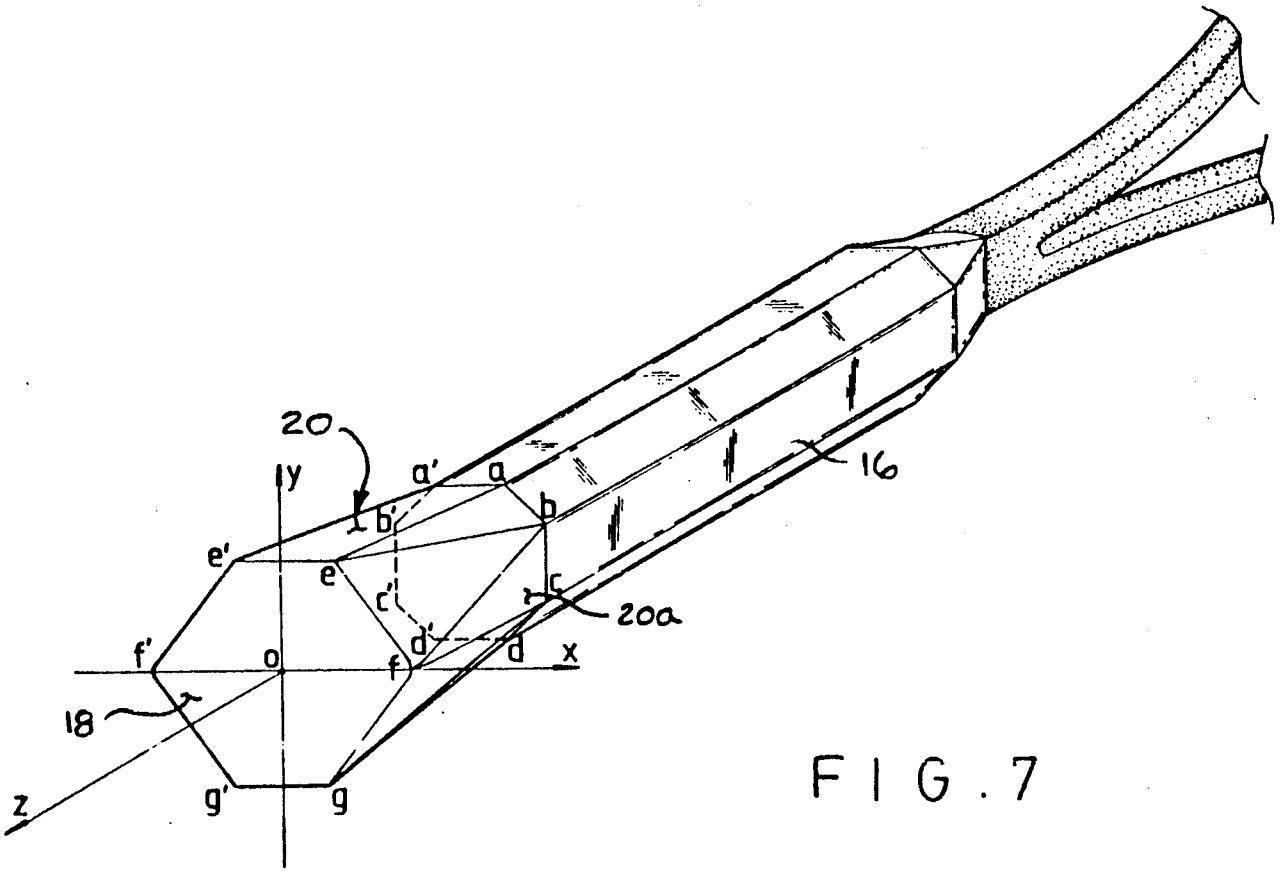
FIG. 7 is a partial, perspective view of the tennis racket handle having an octagonal cross-section at the middle portion and a hexagonal cross-section at the butt-end plane.

As illustrated in FIG. 7, the tennis racket handle of the invention herein, consists of two dissimilar polygons integrated to form a new interconnecting polyhedron in a transition zone 20. As shown, the middle portion (a distance approximately 12 cm from the butt end of the tennis racket handle) of the aforementioned tennis racket handle 16 has an octagonal cross-section represented by points a, b, c, d, d', c', b', and a', while the butt end 18 has a hexagonal cross-section represented by points e, f, g, g', f' and e'. The aforementioned octagon and hexagon are integrated to produce a new transition polyhedron 20. If the tennis racket handle is viewed cross-sectionally and the cross-sectional image is projected from the original point toward the butt end, what can be observed from the spatial coordinates of the same octant is the relationship between the oblique sides of the two mutually integrated, but dissimilar polygon shapes. The corresponding oblique sides of the two dissimilar shapes may be parallel to each other, or not parallel to each other. If the corresponding oblique sides are parallel to each other, the mutual integration of the two dissimilar shapes can be illustrated by the seven types of parallel relationships below: (1) Two sides in parallel: such as the sides of a triangular cross-section and the sides of the cross-sectional octagon of conventional octahedral tennis racket handles (further elaborated below); (2) Three sides in parallel: such as a triangle and pentagon: (3) Four sides in parallel; such as a rhomb; (4) Five sides in parallel; such as a pentagon; (5) Six sides in parallel: such as a hexagon; (6) Seven sides in parallel such as a septilateral; (7) Eight sides in parallel: such as an octagon and decagon. Of these examples, the parallel sides of an octagon offers unlimited possibilities in terms of integrating the sides of polygons, but any polygon of ten sides or less is suitable for usage as a tennis racket handle. If all of the corresponding oblique sides are not parallel to each other, the octagon and other polygons still have four sides that are parallel to each other. If a projection of the parallel line segments is made from an original point, these are parallel lines in space and two parallel line segments constitute one plane. If a positive projection of non-parallel line segments is made from an original point, the resulting three points constitute a plane. Since the aforesaid two line segments are not in parallel, the four end points of the aforesaid two line segments form two triangular facets. As a result, the integration of polygons with different numbers of sides produces a number of interconnected triangular facets 20*a*, as shown by the new polyhedron depicted in FIG. 7. The shape of the aforesaid polygon resembles interconnected wedges which resemble the cross-section of a diamond.

As indicated in FIG. 7, the new shape of the tennis racket handle of the invention differs from conventional octagonal cross-section tennis racket handle, wherein: (1) the laterally protruding point b corner section of the original conventional octagon is changed into a flat surface defined by points ebf; (2) the tennis racket handle middle portion having octagonal cross-section abcdd'c'b'a' and the butt-end plane hexagon efgg'f'e' are two cross-sections which are dissimilar in shape and, moreover, are mutually integrated by a transition polyhedron; (3) the flat surfaces formed on the aforementioned polyhedron are wedge-shaped and interconnected; (4) on the butt end of the tennis racket handle, there are two sides parallel to the horizontal axis and four oblique sides; (5) the oblique sides $\overline{ef}$, $\overline{fg}$, $\overline{e'f'}$ and $\overline{f'g'}$ are larger than the sides which are parallel to the vertical axis and, moreover, the sides parallel to the vertical axis can equal to 0 (zero).

Figure 8:
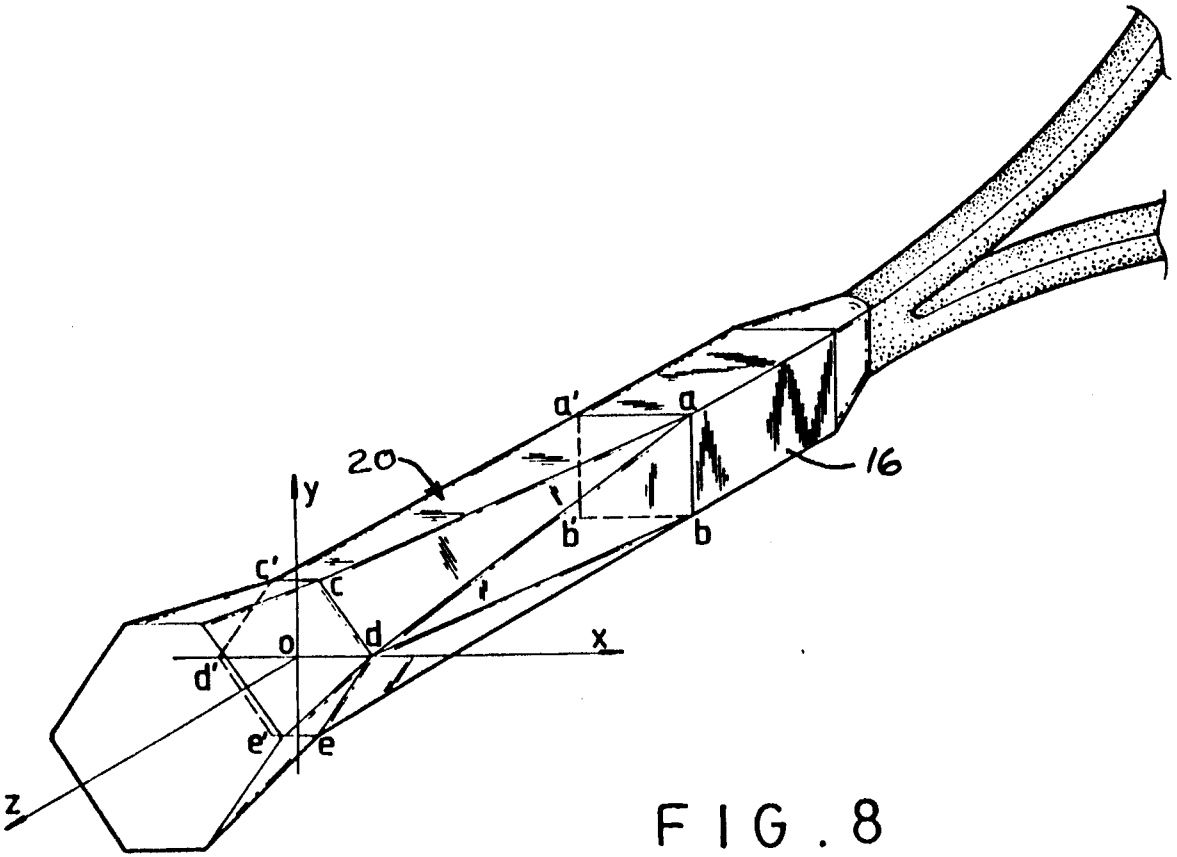
FIG. 8 is a partial, perspective view of a tennis racket having a handle according to a fourth embodiment of the present invention with a tetragonal cross-section at the middle portion and a hexagonal cross-section at the butt-end plane.

As illustrated in FIG. 8, another embodiment is depicted wherein tetragon abb'a' at the middle portion of a tennis racket handle converges into hexagon cdee'd'c' at the butt end of a tennis racket handle which, as indicated in the aforementioned FIG. 7, is enabled by wedge-shaped planar surfaces and, furthermore, the length of oblique sides, such as $\overline{cd}$, is greater than the sides which are parallel to the horizontal axis, thereby eliminating the laterally protruding points and providing a comfortable flat gripping surface Δacd.

Figure 9:
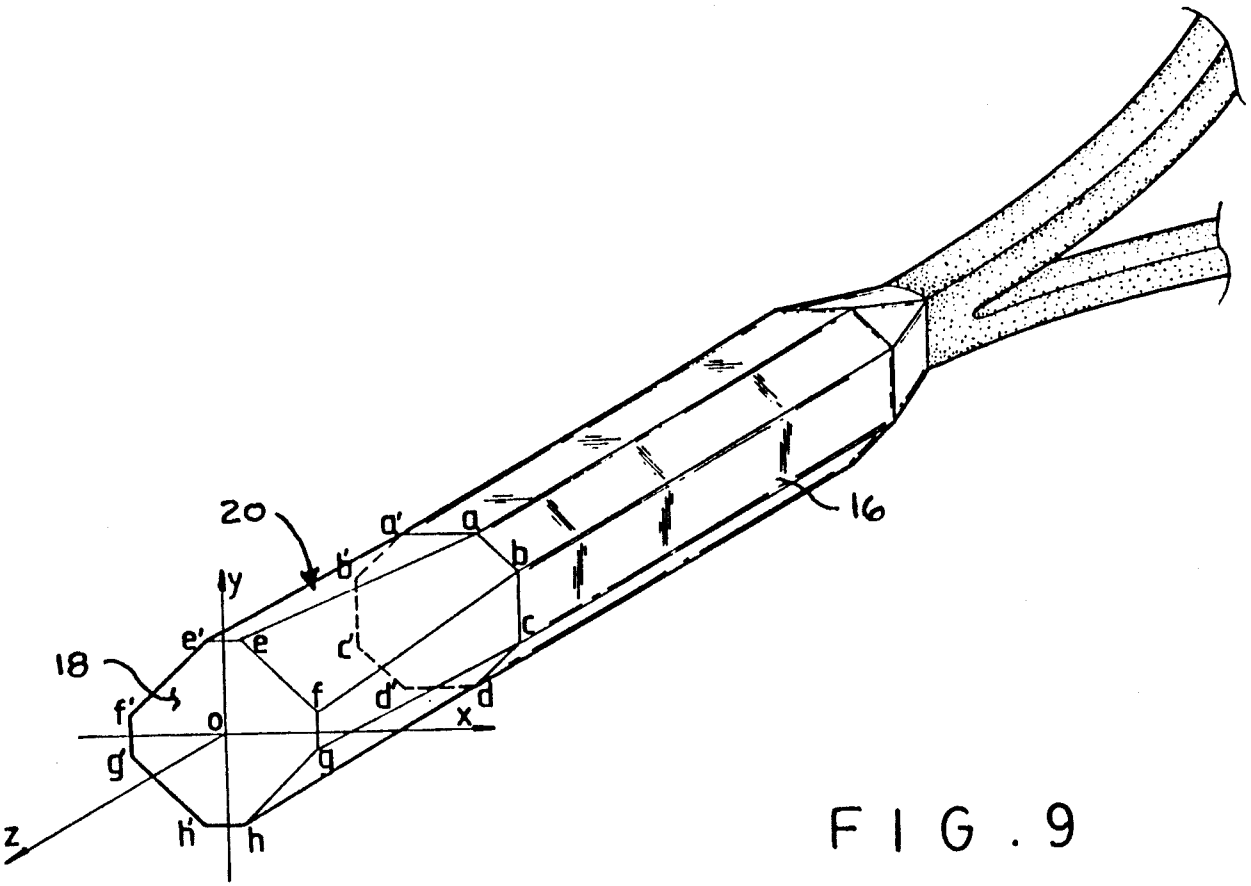
FIG. 9 is a partial, perspective view of a tennis racket having a handle according to a fifth embodiment of the present invention having a middle portion and a butt-end plane which are dissimilar octagons.

As illustrated in FIG. 9, the cross-sectional configuration abcdd'c'b'a' at the middle portion of a tennis racket handle and the planar figure efghh'g'f'e' at the butt end are two mutually integrated polygons which are both octagons with all the opposite sides in parallel. However, the aforesaid polygons are examples of dissimilarly shaped octagons and the integration changes are similar in external appearance to the butt end of most conventional tennis racket handles, wherein the oblique sides $\overline{ef}$, $\overline{gh}$, $\overline{gh}$ and $\overline{ef}$ are larger than sides $\overline{fg}$ and $\overline{f'g'}$, which are parallel to the vertical axis.

Based on the aforementioned descriptions of the invention herein, two dissimilar polygons are integrated, one at the middle portion and one at the butt end of a tennis racket handle by a transition polyhedron. The number of sides of the transition polyhedron is obtained by adding the number of sides of the middle portion to the number of sides of the butt end and subtracting the number of facing extending parallel sides in the two polygons. The number obtained in this process equals the number of planar surfaces of the transition polyhedron. As illustrated in FIG. 7, the hexagon at the butt end has two sides ($\overline{ee}$; $\overline{gg}$) that are parallel to the sides of the octagon and which are parallel to the horizontal axis. Thus, $(8+6)-2=12$. 12 equals the number of planar surfaces of the new transition polyhedron. As illustrated in FIG. 9, the octagon at the butt end has eight sides that are parallel to sides of the octagon of the middle portion. Thus, $(8+8)-8=8$ which equals the number of planar surfaces of the new transition polyhedron.

As illustrated in FIG. 10 and FIG. 10-A, when the sides of the two line segments a a and d d (which are parallel to the horizontal axis) are connected, the octagon abcdd'c'b'a' becomes the rectangle add'a' and the remaining two sections form trapezoids abcd and $\overline{a'b'c'd'}$. From this can be obtained a suitable exterior arc (FIG. 10) and an inscribed arc (FIG. 10A). Thence on both sides of the defined arcs can be obtained a suitable polygon. Furthermore, the conversion of the aforesaid polygon enables the production of a new transition polyhedron on the tennis racket handle.

Figure 11:
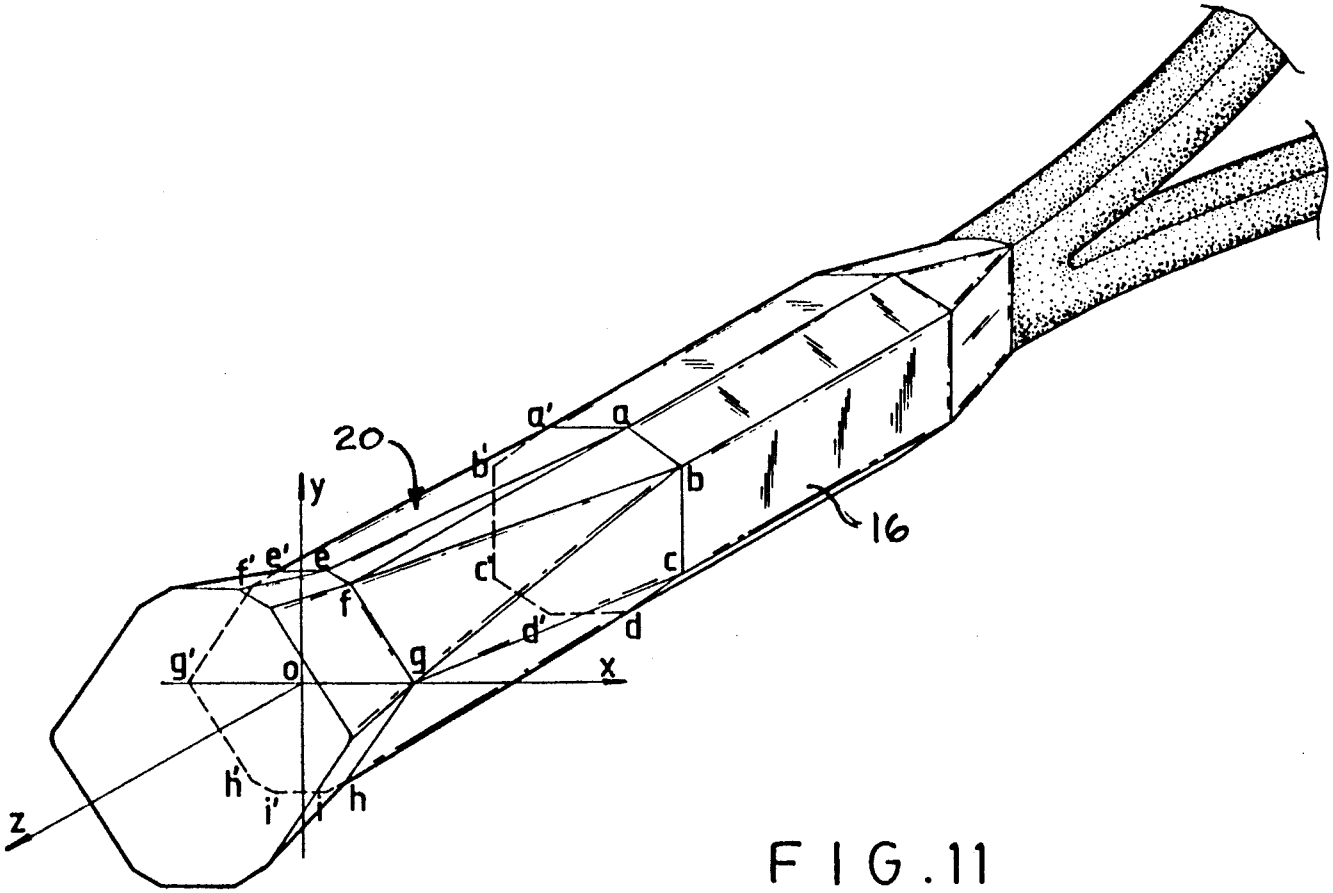
FIG. 11 is a partial, perspective view of the tennis racket having a handle according to the sixth embodiment of the present invention having an octagonal cross-section at the middle portion and dodecagonal cross-section at the butt end.

As illustrated in FIG. 11, the octagon abcdd'c'b'a' at the middle portion of the tennis racket handle is integrated with the dodecagon efghii'h'g'f'e' at the butt end of the tennis racket handle. As similarly illustrated in the aforementioned FIG. 7, FIG. 8 and FIG. 9, a new improved shaped is produced on the butt end of the tennis racket handle, wherein the wedge-shaped planar surfaces Δfbg and so on are formed, the oblique side $\overline{fg}$ is larger than the sides parallel to the vertical axis. Thus, the lateral protruding points are eliminated and converted into comfortable flat gripping surfaces.

Figure 12:
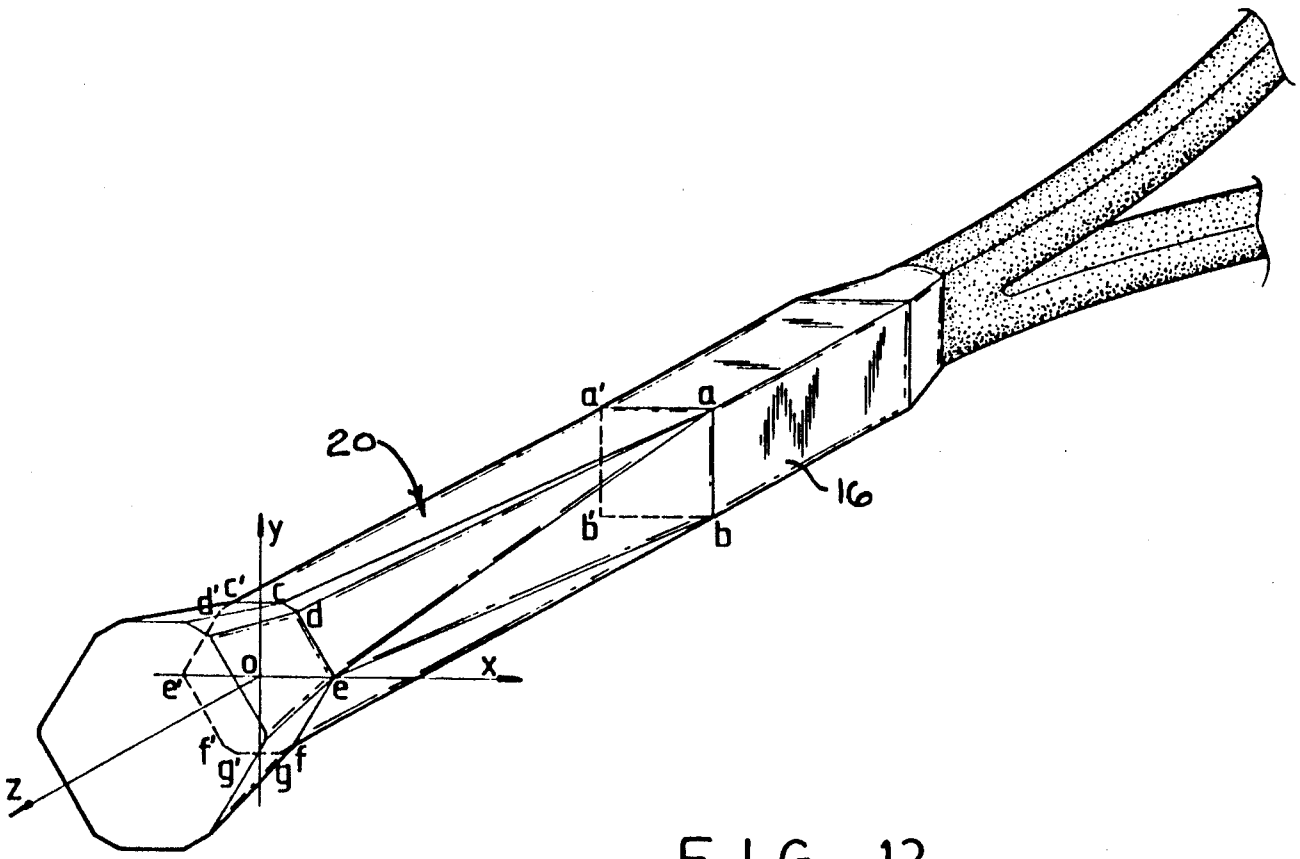
FIG. 12 is a partial, perspective view of the tennis racket having a handle according to a seventh embodiment of the present invention having a tetragonal cross-section at the middle portion and dodecagonal cross-section at the butt end.

As illustrated in FIG. 12, the tetragon abb'a' at the middle portion of the tennis racket handle is integrated with the dodecagon cdefgg'f'e'd'c' at the butt end of the tennis racket handle. As similarly illustrated in the aforementioned FIG. 7, FIG. 8, FIG. 9 and FIG. 11, a new improved shape resembling the facet of a diamond is produced as well as the wedge-shaped planar surfaces Δcad, Δdae and so on. Furthermore, the oblique sides, such as $\overline{de}$ are larger than the sides parallel to the vertical axis. The lateral protruding points are eliminated and converted in comfortable flat gripping surfaces.

The aforementioned examples utilized to describe the invention herein shall not be construed as limitation upon the rights of the invention herein, and, furthermore, related modifications to specific items and performance shall remain within the scope of the invention herein.

I claim:

1. A handle for a tennis racket to improve the grip and the grasping action at the hypothenar eminence of the palm, the tennis racket having a head portion with a planar hitting surface, the handle comprising:

a) a middle portion having a first polygonal cross-section;

b) a butt end portion facing way from the head portion and having a second polygonal cross-section, the polygon of the butt portion cross-section being different in shape from the polygon of the middle portion cross-section wherein the polygon of the butt portion comprises opposite, parallel sides extending obliquely to the plane of the hitting surface; and, c) a transition zone connecting the middle portion to the butt portion, a cross-section of the transition zone comprising a polyhedron having a number of sides $N_T$ such that:

$$N_t=(N_M+N_B)-N_P$$

where:

$N_T$=number of sides of transition zone cross-section;

$N_M$=number of sides of polygon at middle portion;

$N_B$=number of sides of polygon at butt portion; and, $N_P$=number of sides of middle portion and butt portion polygons that are parallel to each other in an octant.

2. The tennis racket handle of claim 1 wherein the opposite oblique sides of the butt portion polygon are substantially equal in length.

3. The tennis racket handle of claim 1 wherein the lengths of the oblique sides of the butt portion polygon are greater than lengths of the sides of the butt portion polygon which extend parallel to the plane of the hitting surface.

4. The tennis racket handle of claim 1 wherein the cross-section of the middle portion is located within 12 cm. of the butt end of the handle.

5. The tennis racket handle of claim 1 wherein the area of the butt portion polygon is greater than the area of the polygon of the middle portion.

6. The tennis racket handle of claim 1 wherein the butt portion polygon is a symmetrical polygon.

7. The tennis racket handle of claim 1 wherein the minimum number of sides of the butt portion polygon extending parallel to the plane of the hitting surface is zero.

8. The tennis racket handle of claim 1 wherein the polygon of the middle portion is an octagon.

9. The tennis racket handle of claim 8 wherein the butt portion polygon is a hexagon.

10. The tennis racket handle of claim 8 wherein the butt portion polygon is a tetragon.

11. The tennis racket handle of claim 8 wherein the butt portion polygon comprises an octagon dissimilar to the octagon of the middle portion.

12. The tennis racket handle of claim 8 wherein the butt portion polygon is a decagon.

13. The tennis racket handle of claim 1 wherein the polygon of the middle portion is a tetragon.

14. The tennis racket handle of claim 13 wherein the butt portion polygon is a hexagon.

15. The tennis racket handle of claim 13 wherein the butt portion polygon is a decagon.

16. A handle for a tennis racket to improve the grip and the grasping action at the hypothenar eminence of the palm, the tennis racket having a head portion with a planar hitting surface, the handle comprising:

a) a middle portion having a first polygonal cross-section;

b) a butt end portion facing way from the head portion and having a second polygonal cross-section, the polygon of the butt portion cross-section being different in shape from the polygon of the middle portion cross-section wherein the minimum number of sides of the butt portion polygon extending parallel to the plane of the hitting surface is zero; and, c) a transition zone connecting the middle portion to the butt portion, a cross-section of the transition zone comprising a polyhedron having a number of sides $N_T$ such that:

$$N_T=(N_M+N_B)-N_P$$

where:

$N_T$=number of sides of transition zone cross-section;

$N_M$=number of sides of polygon at middle portion;

$N_B$=number of sides of polygon at butt portion; and, $N_P$=number of sides of middle portion and butt portion polygons that are parallel to each other in an octant.

17. The tennis racket handle of claim 16 wherein the polygon of the butt portion comprises opposite, parallel sides extending obliquely to the plane of the hitting surface and wherein the opposite oblique sides of the butt portion polygon are substantially equal in length.

18. The tennis racket handle of claim 16 wherein the cross-section of the middle portion is located within 12 cm. of the butt end of the handle.

19. The tennis racket handle of claim 16 wherein the area of the butt portion polygon is greater than the area of the polygon of the middle portion.

20. The tennis racket handle of claim 16 wherein the butt portion polygon is a symmetrical polygon.

21. The tennis racket handle of claim 16 wherein the polygon of the middle portion is an octagon.

22. The tennis racket handle of claim 21 wherein the butt portion polygon is a hexagon.

23. The tennis racket handle of claim 21 wherein the butt portion polygon is a tetragon.

24. The tennis racket handle of claim 21 wherein the butt portion polygon is a decagon.

25. The tennis racket handle of claim 16 wherein the polygon of the middle portion is a tetragon.

26. The tennis racket handle of claim 25 wherein the butt portion polygon is a hexagon.

27. The tennis racket handle of claim 25 wherein the butt portion polygon is a decagon.

* * * * *